US007013572B1

(12) United States Patent
Morganti et al.

(10) Patent No.: US 7,013,572 B1
(45) Date of Patent: Mar. 21, 2006

(54) SKIVE PLATE ASSEMBLY

(75) Inventors: Terry N. Morganti, Brockport, NY (US); Richard C. Baughman, Geneseo, NY (US)

(73) Assignee: Eastman Kodak Company, Rochester, NY (US)

( * ) Notice: Subject to any disclaimer, the term of this patent is extended or adjusted under 35 U.S.C. 154(b) by 19 days.

(21) Appl. No.: 10/808,153

(22) Filed: Mar. 24, 2004

Related U.S. Application Data

(60) Provisional application No. 60/459,109, filed on Mar. 31, 2003.

(51) Int. Cl.
*G03G 15/20* (2006.01)

(52) U.S. Cl. ..... 33/323

(58) Field of Classification Search ..... 399/323, 399/322

See application file for complete search history.

(56) References Cited

U.S. PATENT DOCUMENTS

| | | | | |
|---|---|---|---|---|
| 3,951,538 | A * | 4/1976 | Bar-on | 399/331 |
| 4,062,534 | A * | 12/1977 | Sasahara | 271/311 |
| 4,771,310 | A * | 9/1988 | Leo et al. | 399/323 |
| 5,289,244 | A * | 2/1994 | Takano | 399/322 |
| 5,579,097 | A * | 11/1996 | Tomoe et al. | 399/323 |
| 6,295,436 | B1 * | 9/2001 | Morganti et al. | 399/323 |
| 6,522,858 | B1 * | 2/2003 | Morganti et al. | 399/323 |
| 6,564,030 | B1 * | 5/2003 | Baughman et al. | 399/323 |
| 2004/0170454 | A1 * | 9/2004 | Gomi et al. | 399/323 |

FOREIGN PATENT DOCUMENTS

| | | | |
|---|---|---|---|
| JP | 54065550 | A * | 5/1979 |
| JP | 03164777 | A * | 7/1991 |
| JP | 03225385 | A * | 10/1991 |
| JP | 06118818 | A * | 4/1994 |
| JP | 07261585 | A * | 10/1995 |
| JP | 2003122171 | A * | 4/2003 |
| JP | 2004205748 | A * | 7/2004 |

* cited by examiner

*Primary Examiner*—R. Alexander Smith
(74) *Attorney, Agent, or Firm*—Donna Suchy

(57) ABSTRACT

A skive plate assembly for aiding receiver sheet removal from a roller in a fuser in an electrographic process, comprises a base plate, a skive plate having a central portion, and a skive plate attachment rigidly connecting the skive plate to the base plate such that the base plate and the skive plate define an air passage slot intermittently interrupted by the skive plate attachment, the skive plate defining a terminal edge positioned to face the roller, wherein a distance between the terminal edge and the base plate decreases with distance from the skive plate central portion. According to a further aspect of the invention, the terminal edge defines a gap with the roller, wherein the gap between the terminal edge and the roller is constant along the length of the skive plate.

23 Claims, 4 Drawing Sheets

SKIVE PLATE ASSEMBLY

CROSS-REFERENCE TO RELATED APPLICATIONS

This application claims the benefit of U.S. Provisional Patent Application Ser. No. 60/459,109 filed Mar. 31, 2003.

BACKGROUND

The present invention is in the field of fuser stations for image forming machines. More specifically this invention relates to the skive plate assembly for aiding receiver sheet removal from a roller in a fuser in an electrographic process.

An image-forming machine transfers images onto a receiving sheet. This is done by selectively charging and then optically exposing a photoconductor to form an electrostatic latent image on the surface. Toner is deposited onto the photoconductor surface. The toner is charged, thus adhering to the photoconductor surface in areas corresponding to the electrostatic latent image. This pattern of toner is then transferred to the receiving sheet at a transfer station. The transfer station charges the medium to an opposing voltage, so that the toner on the photoconductor is attracted to the receiving sheet as it is placed in proximity to the photoconductor.

The transferred toner is not permanently fixed to the medium at the transfer station, however. Conventional electrographic printers have a fixing, or fusing, station located downstream from the transfer station, at which the transferred toner pattern is fused to the medium. Conventional fusing stations apply heat and pressure to fuse the transferred toner to the medium, after which it travels to a finishing station in the printer for collating, sorting, stapling or other binding, and other finishing operations.

A fuser station typically has a fuser roller, a pressure roller, and upper and lower skive assemblies. The fuser and pressure rollers are disposed to form a nip, or pinch region. The receiving sheet enters the nip to have the image fused onto it. The receiving sheet then exits the nip. The upper and lower skive assemblies are located adjacent to the exit of the nip to help remove and guide the receiving sheet away from the fusing and pressure rollers. The upper skive assembly typically has a number of skives, which are typically thin flexible elements extending towards the fusing roller to help strip the receiving sheet from the roller. A deflector plate is also used to help guide the receiving sheet into a decurler nip.

There are several problems associated with the previous designs. One such problem is "stubbing" of the skive plate on the roller, which can damage the roller. Another problem is condensation of water on the surface of the upper skive assembly. This is caused by water driven out of the receiver sheet by the high temperature of the fusing roller. This condensation forms droplets that may then drip onto a receiver sheet causing a visual defect.

To reduce the problem of condensation forming on the upper skive assembly, U.S. Pat. No. 6,564,030 by Baughman et al, which is hereby incorporated by reference, discloses a vented deflector plate. While this does reduce condensation considerably, heavier weight and larger size papers produce more condensation that is not completely dissipated with this design.

A skive plate assembly is desired which would reduce condensation even for larger and/or heavier weight papers, and which would not stub the roller.

SUMMARY OF THE INVENTION

A skive plate assembly for aiding receiver sheet removal from a roller in a fuser in an electrographic process, comprises a base plate, a skive plate having a central portion, and a skive plate attachment rigidly connecting the skive plate to the base plate such that the base plate and the skive plate define an air passage slot intermittently interrupted by the skive plate attachment, the skive plate defining a terminal edge positioned to face the roller, wherein a distance between the terminal edge and the base plate decreases with distance from the skive plate central portion. According to a further aspect of the invention, the terminal edge defines a gap with the roller, wherein the gap between the terminal edge and the roller is constant along the length of the skive plate.

DETAILED DESCRIPTION

Figure 1:
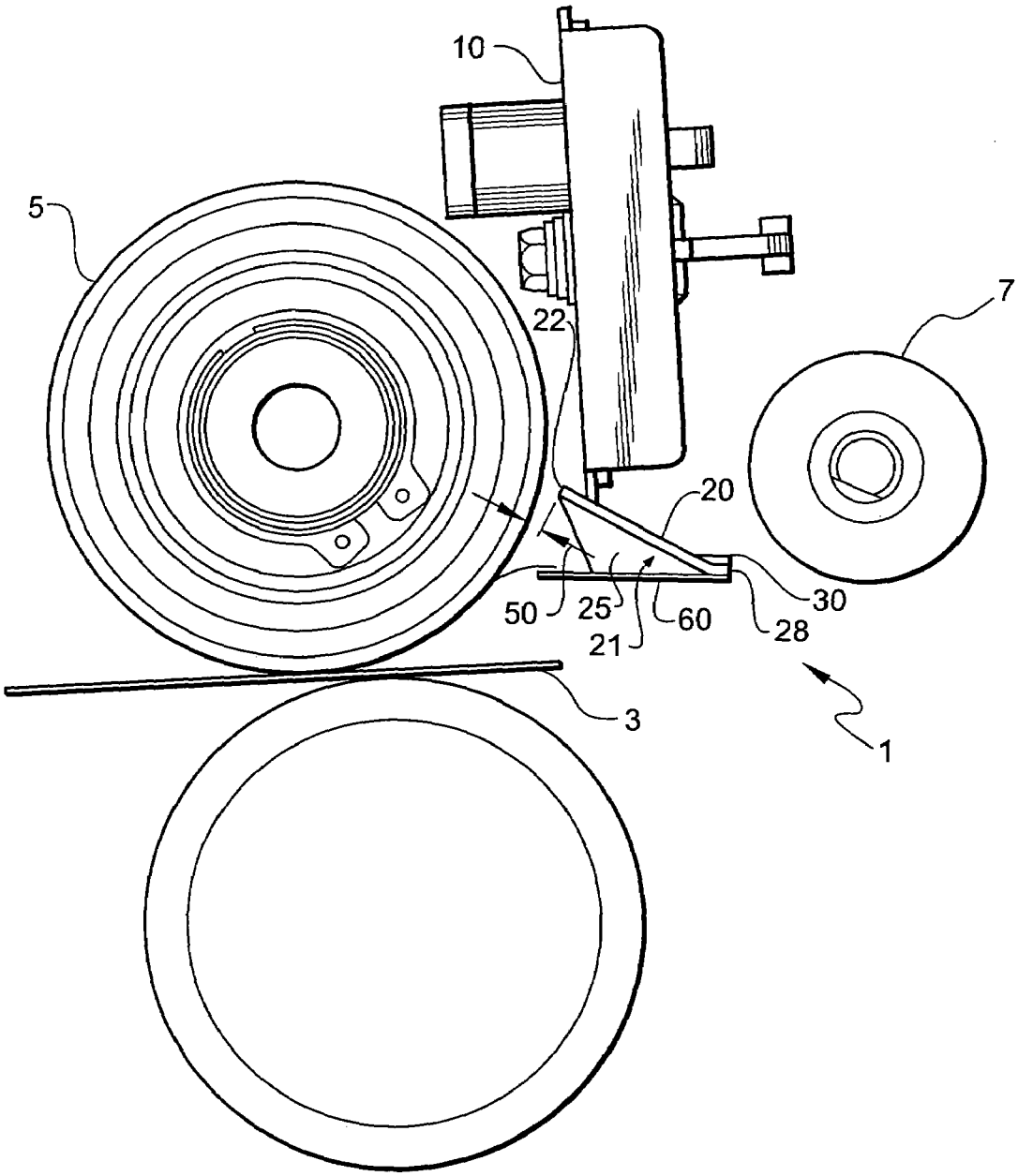
FIG. 1 is a side view of a skive plate assembly and part of a fuser station according to an aspect of the invention.

Various aspects of the invention are presented in FIGS. 1–4 which are not drawn to scale and in which like components are numbered alike. Referring now to FIGS. 1–4, according to an aspect of the invention, a skive plate assembly 1 for aiding receiver sheet 3 removal from a roller 5 in a fuser in an electrographic process, comprises a base plate 10, a skive plate 20, and a skive plate attachment 30. The skive plate attachment 30 rigidly attaches the skive plate 20 to the base plate 10 such that the base plate 10 and the skive plate 20 define an air passage slot 40 intermittently interrupted by the skive plate attachment 30. The skive plate has a central portion 26 and further defines a terminal edge 22 positioned to face the roller 5, wherein a distance 42 between the terminal edge 22 and the base plate 10 decreases with distance from the skive plate central portion 26.

Figure 2:
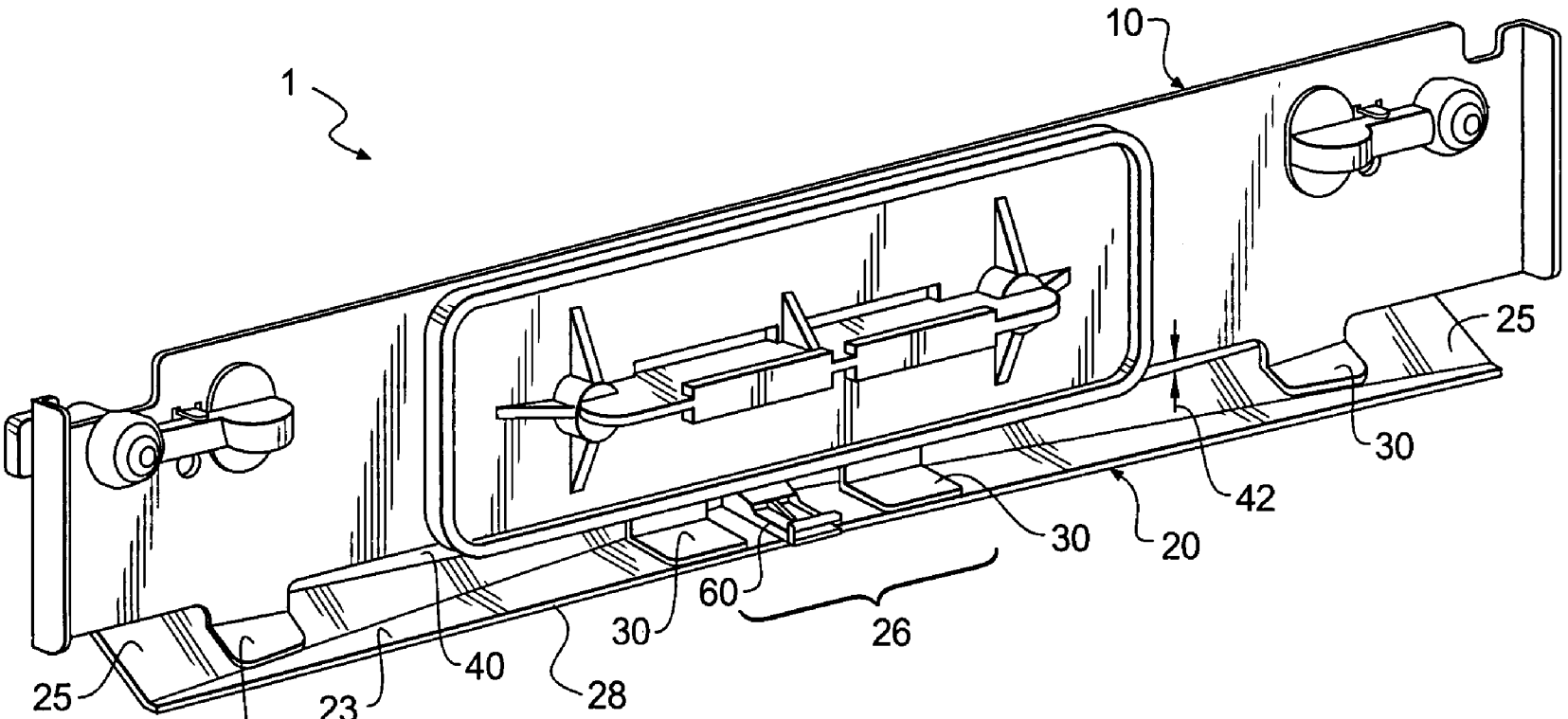
FIG. 2 is an isometric back view of a skive plate assembly according to an aspect of the invention.
Figure 3:
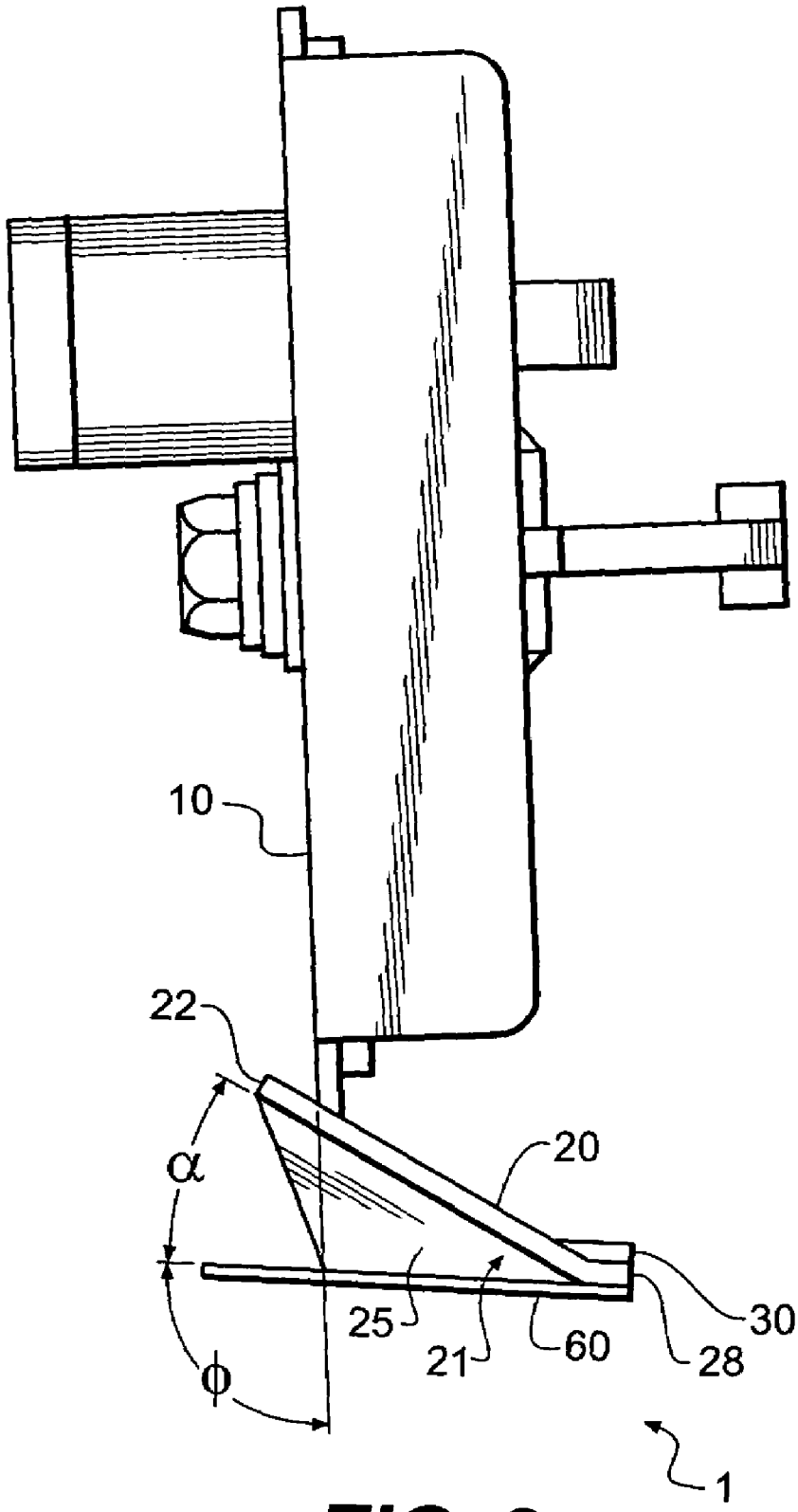
FIG. 3 is a side view of a skive plate assembly according to an aspect of the invention.

The skive plate attachment 30 is shown in FIG. 2 as tabs extending from the base plate 10. The skive plate attachment is not in any way limited to these tabs, but may be a weld, nuts and bolts, screws, or any other suitable attachment, the type of which is not critical to this invention. FIG. 2 shows 4 skive plate attachments 30, at four different attachments points. Two are shown in the skive plate central portion 26, on either side of the skive blade 60, and two are shown towards the ends of the skive plate 20. This is not intended to limit the skive plate attachments 30 to a certain placement, or a certain number. Skive plate attachments 30 may be just in the central portion 26, just towards the ends of the skive plate 20, or anywhere in between. However, because the air passage slot 40 is defined by the skive plate 20 and the base plate 10 as intermittently interrupted by the skive plate attachments 30, the greater the number and/or size of the skive plate attachments 30, the smaller the slot 40 area. This design is therefore optimized when the attachments 30 are large enough in size and number to maintain a rigid attachment, and no larger; although optimization is not necessary for utilization of this invention.

In a preferred embodiment the air passage slot 40 is approximately 3/16 to ½ inch wide along the length of the skive plate 20.

In a further embodiment, the terminal edge 22 defines a gap 50 (see FIG. 1) with the roller 5, and that gap 50 is constant along the length of the skive plate 20. In order to maintain a constant gap 50, the overall width of the skive plate 20 and/or the angle of the skive plate relative to the roller 5 may have to be adjusted.

According to a further aspect of the invention, the base plate 10 and the skive plate 20 are at a greater than 90° angle $\phi$ relative to each other. In a preferred embodiment, the angle $\phi$ is approximately 94°. This angle helps prevent stubbing of the skive plate 20 on the roller 5.

In a further preferred embodiment, the skive plate 20 comprises a skive plate surface 24 convex toward the roller 5. This shape is what causes the distance 42 between the terminal edge 22 and the base plate 10 to decrease with distance from the skive plate central portion 26.

Figure 4:
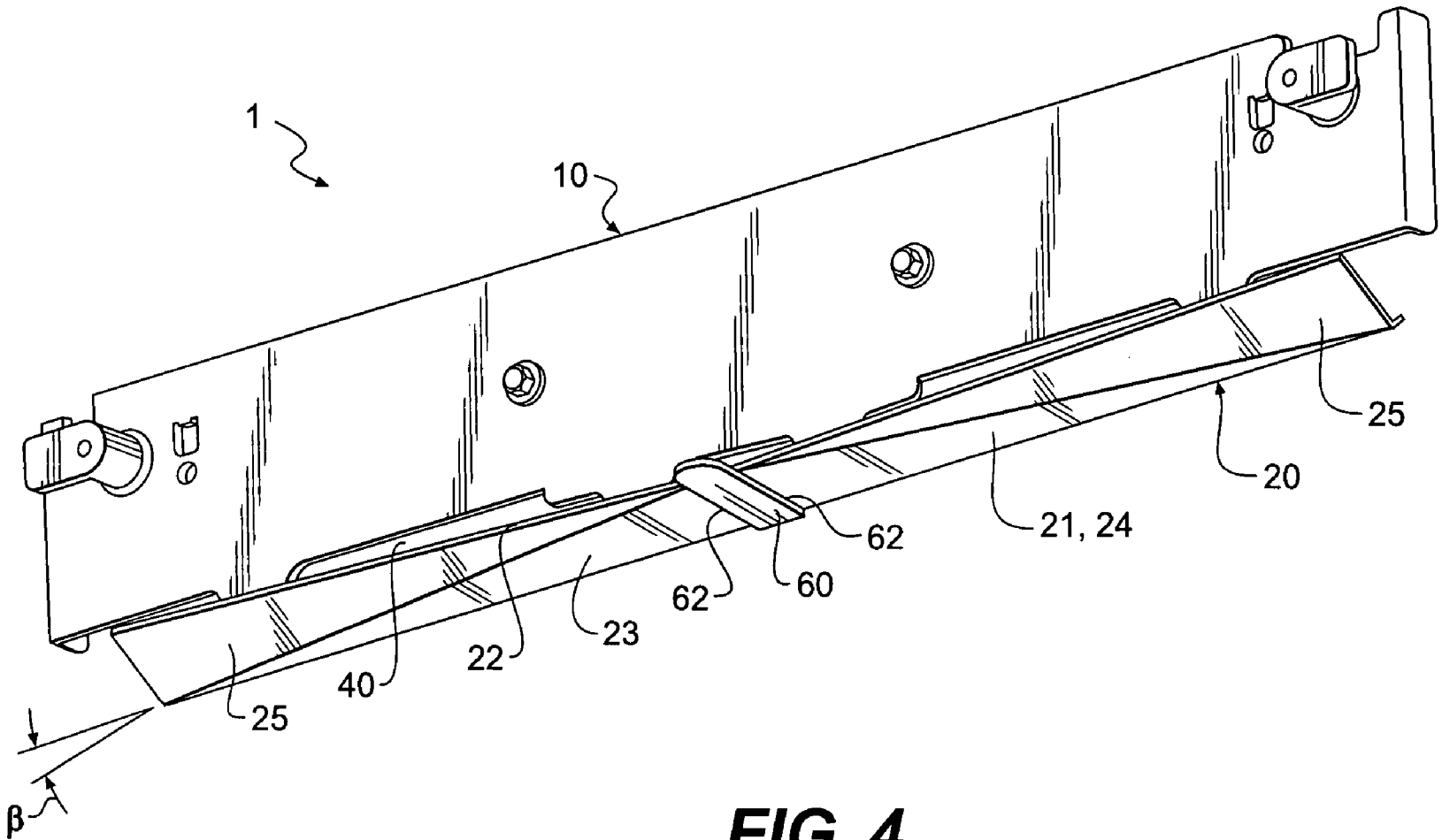
FIG. 4 is an isometric bottom view of a skive plate assembly according to an aspect of the invention.

Referring now to FIG. 4, the convex skive plate surface 24 may be composed of flat facets. In a preferred embodiment, the skive plate 20 further defines a trailing edge 28 which opposes the skive plate terminal edge 22. The convex skive plate surface 24 is composed of three flat facets, with one of the facets, a base facet 23, extending along the length of the skive plate trailing edge 28, and the other two facets 25 beginning from the central portion 26 and extending outward in opposite directions along the length of the skive plate 20. The shape of this skive plate 20 guides receiving sheets into the decurler roller 7 without the use of a deflector.

In a preferred embodiment, the base facet 23 is at approximately a 94° angle $\phi$ relative the base plate 10, and the other two facets 25 form an angle $\alpha$ approximately 28 degrees from a plane of the base facet 23 towards the base plate 10, and extend outward in opposite directions along the length of the skive plate 20 at approximately a 7° angle $\beta$, with respect to the skive plate trailing edge 28.

In a further preferred embodiment, the skive plate assembly 1 further comprises at least one skive blade 60 mounted on the skive plate 20, extending towards the roller 5 (see FIG. 1). Skive blades 60 are typically mounted on the bottom surface 21 of a skive plate 20, and used to strip a receiving sheet off the pressure roller. During use, skive blades tend to collect residue at the tips of the blades. This residue may consist of paper dust, oil and toner mixed together. This residue may fall off, and contaminate the pressure roller, or receiver sheets. To reduce the likelihood of residue causing visual defects on the receiver sheets, a preferred embodiment is to have a single skive blade 60 mounted to the center portion 26 of the skive plate 20.

According to a further aspect of the invention, a skive blade 60 mounted on the skive plate center portion 26, extending towards the roller, and the skive plate 20 comprises a skive plate surface 24 convex toward the roller 5, and composed of three flat facets with one of the facets, a base facet 23, extending along a length of the skive plate 20 which comprises the trailing edge 28 opposite the skive plate terminal edge 22, and the other two beginning from opposing edges 62 of the skive blade 60 and extending outward in opposite directions along the length of the skive plate 20.

According to an aspect of the invention, a skive plate assembly 1 for aiding receiver sheet 3 removal from a roller 5 in a fuser in an electrographic process, comprises a base plate 10, a skive plate 20, and a skive plate attachment 30. The skive plate attachment 30 rigidly attaches the skive plate 20 to the base plate 10 such that the base plate 10 and the skive plate 20 define an air passage slot 40 intermittently interrupted by the skive plate attachment 30. The skive plate has a central portion 26 and further defines a terminal edge 22 positioned to face the roller 5, the terminal edge 22 defines a gap 50 with the roller 5, and that gap 50 is constant along the length of the skive plate 20.

The above description defines many feature of the present invention, any combination of which is within the purview of this invention, even if not specifically discussed.

What is claimed is:

1. A skive plate assembly for aiding receiver sheet removal from a roller in a fuser in an electrographic process, comprising:

a base plate;

a skive plate having a central portion; and, a skive plate attachment rigidly connecting the skive plate to said base plate such that said base plate and said skive plate define an air passage slot intermittently interrupted by said skive plate attachment, the skive plate defining a terminal edge positioned to face the roller, wherein a distance between the terminal edge and the base plate decreases with distance from said skive plate central portion.

2. The skive plate assembly of claim 1 wherein said air passage slot is approximately 3/16 to ½ inch wide along the length of said skive plate.

3. The skive plate assembly of claim 1 wherein said base plate and said skive plate are at a greater than 90 degree angle relative to each other.

4. The skive plate assembly of claim 1 wherein said base plate and said skive plate are at an approximately 94 degree angle relative to each other.

5. The skive plate assembly of claim 1, wherein the skive plate comprises a skive plate surface convex toward the roller.

6. The skive plate assembly of claim 1, wherein the skive plate comprises a skive plate surface convex toward the roller and composed of flat facets.

7. The skive plate assembly of claim 1, wherein said skive plate further defines the trailing edge which opposes said skive plate terminal edge, wherein the skive plate comprises a skive plate surface convex toward the roller and composed of three flat facets with one of the facets, a base facet, extending along said skive plate trailing edge, and the other two facets beginning from the central portion and extending outward in opposite directions along the length of the skive plate.

8. The skive plate assembly of claim 7 wherein said skive plate has the terminal edge positioned to face the roller, wherein the terminal edge defines a gap with the roller, wherein the gap between the terminal edge and the base plate is constant along the length of said skive plate.

9. The skive plate assembly of claim 1 further comprising at least one skive blade mounted on said skive plate, extending towards the roller.

10. The skive plate assembly of claim 1 further comprising one skive blade mounted on said skive plate central portion, extending towards the roller.

11. The skive plate assembly of claim 1, wherein said skive plate further defines a trailing edge which opposes said skive plate terminal edge, further comprising a skive blade mounted on said skive plate central portion, extending towards the roller, and wherein the skive plate comprises a skive plate surface convex toward the roller and composed of three flat facets with one of the facets, a base facet, extending along said skive plate trailing edge, and the other two beginning from opposing edges of the skive blade and extending outward in opposite directions along the length of the skive plate.

12. The skive plate assembly of claim 11 wherein said base facet is at approximately a 94 degree angle relative the said base plate, and wherein the other two facets angle approximately 28 degrees from the base facet towards the base plate, and extend outward in opposite directions along the length of the skive plate at approximately a 7 degree angle with respect to the skive plate terminal trailing edge.

13. A skive plate assembly for aiding receiver sheet removal from a roller in a fuser in an electrographic process, comprising:

a base plate;

a skive plate having a central portion; and, a skive plate attachment rigidly connecting said skive plate to said base plate such that said base plate and said skive plate define an air passage slot intermittently interrupted by said skive plate attachment, the skive plate defining a terminal edge positioned to face the roller, wherein a distance between the terminal edge and the base plate decreases with distance from the plate central portion, and wherein the terminal edge defines a gap with the roller, wherein the gap between the terminal edge and the roller is constant along the length of said skive plate.

14. The skive plate assembly of claim 13 wherein said air passage slot is approximately 3/16 to 1/2 inch wide along the length of said skive plate.

15. The skive plate assembly of claim 13 wherein said base plate and said skive plate are at a greater than 90 degree angle relative to each other.

16. The skive plate assembly of claim 13 wherein said base plate and said skive plate are at an approximately 94 degree angle relative to each other.

17. The skive plate assembly of claim 13, wherein the skive plate comprises a skive plate surface convex toward the roller.

18. The skive plate assembly of claim 13, wherein the skive plate comprises a skive plate surface convex toward the roller and composed of flat facets.

19. The skive plate assembly of claim 13, wherein said skive plate further defines a trailing edge which opposes said skive plate terminal edge, wherein the skive plate comprises a skive plate surface convex toward the roller and composed of three flat facets with one of the facets, a base facet, extending along said skive plate trailing edge, and the other two facets beginning from the central portion and extending outward in opposite directions along the length of the skive plate.

20. The skive plate assembly of claim 13 further comprising at least one skive blade mounted on said skive plate, extending towards the roller.

21. The skive plate assembly of claim 13 further comprising one skive blade mounted on said skive plate central portion, extending towards the roller.

22. The skive plate assembly of claim 13, wherein said skive plate further defines a trailing edge which opposes said skive plate terminal edge, further comprising a skive blade mounted on said skive plate central portion, extending towards the roller, and wherein the skive plate comprises a skive plate surface convex toward the roller and composed of three flat facets with one of the facets, a base facet, extending along said skive plate trailing edge, and the other two beginning from opposing edges of the skive blade and extending outward in opposite directions along the length of the skive plate.

23. The skive plate assembly of claim 22 wherein said base facet is at approximately a 94 degree angle relative the said base plate, and wherein the other two facets angle approximately 28 degrees from the base facet towards the base plate, and extend outward in opposite directions along the length of the skive plate at approximately a 7 degree angle with respect to the skive plate trailing edge.

* * * * *